US005953864A

United States Patent [19]

Beck

[11] Patent Number: 5,953,864

[45] Date of Patent: Sep. 21, 1999

[54] PREFABRICATED MODULAR CONCRETE FOUNDATION WALL SYSTEMS AND METHODS OF CONSTRUCTING PREFABRICATED MODULAR CONCRETE FOUNDATION WALL SYSTEMS

[75] Inventor: William G. Beck, Midland, Mich.

[73] Assignee: Rapid Wall Systems, Gladwin, Mich.

[21] Appl. No.: 08/842,479

[22] Filed: Apr. 23, 1997

[51] Int. Cl.[6] ..... E04B 2/82

[52] U.S. Cl. ..... 52/127.11; 403/407.1; 52/427

[58] Field of Search ..... 52/127.11, 426, 52/427; 403/407.1, 409.1

[56] References Cited

U.S. PATENT DOCUMENTS

| | | | |
|---|---|---|---|
| 2,046,842 | 7/1936 | Goeller . | |
| 2,851,874 | 9/1958 | Carlson . | |
| 2,921,462 | 1/1960 | Wilson . | |
| 3,469,823 | 9/1969 | Blum et al. . | |
| 3,685,241 | 8/1972 | Cooper . | |
| 4,065,890 | 1/1978 | Fenner | 52/27 |
| 4,151,975 | 5/1979 | Williams . | |
| 4,438,612 | 3/1984 | Bernard et al. . | |
| 4,605,529 | 8/1986 | Zimmerman . | |
| 4,751,803 | 6/1988 | Zimmerman . | |
| 4,765,109 | 8/1988 | Boeshart . | |
| 4,874,150 | 10/1989 | Heinzle . | |
| 4,889,310 | 12/1989 | Boeshart . | |
| 4,916,879 | 4/1990 | Boeshart . | |
| 4,934,121 | 6/1990 | Zimmerman . | |
| 5,029,803 | 7/1991 | Schworer . | |
| 5,055,252 | 10/1991 | Zimmerman . | |
| 5,174,083 | 12/1992 | Mussell . | |
| 5,375,810 | 12/1994 | Mathis . | |
| 5,590,975 | 1/1997 | Horntvedt | 52/127.6 X |
| 5,709,016 | 1/1998 | Gulick et al. | 27/2 |

OTHER PUBLICATIONS

Lightweight Concrete Wall Forming System from Lite–Form (4 pages) (Date unknown–but prior art).

Superior Walls Precast Insulated Wall System (8 pages) (Date unknown–but prior art).

*Primary Examiner*—Beth Aubrey

*Attorney, Agent, or Firm*—Reising, Ethington, Barnes, Kisselle, Learman & McCulloch, P.C.

[57] ABSTRACT

A subterranean building structure has a footing surface and end to end matching concrete wall shell segments arranged in longitudinally abutting relation on the footings. One of the wall sections has an embedded, horizontally extending lock part, and the other has an embedded camming assembly receiving the locked part and creating relative movement of the wall segments into sealed, wedged abutting relation with the operation of manipulatable camming assembly which are accessible through the interior walls of the studded concrete wall sections. Within the concrete shell sections, wire mesh reinforcement extends substantially throughout the wall panels and rebar reinforcement is fixed to this reinforcement as well as to each lock part and camming assembly so that a continuous integrated skeleton framework extends through all walls of the basement enclosure and ties all walls together in one integrated steel skeleton or framework. The factory fabricated concrete panels have factory installed insulation, provision for introducing wiring conduit, and wall board as well.

31 Claims, 14 Drawing Sheets

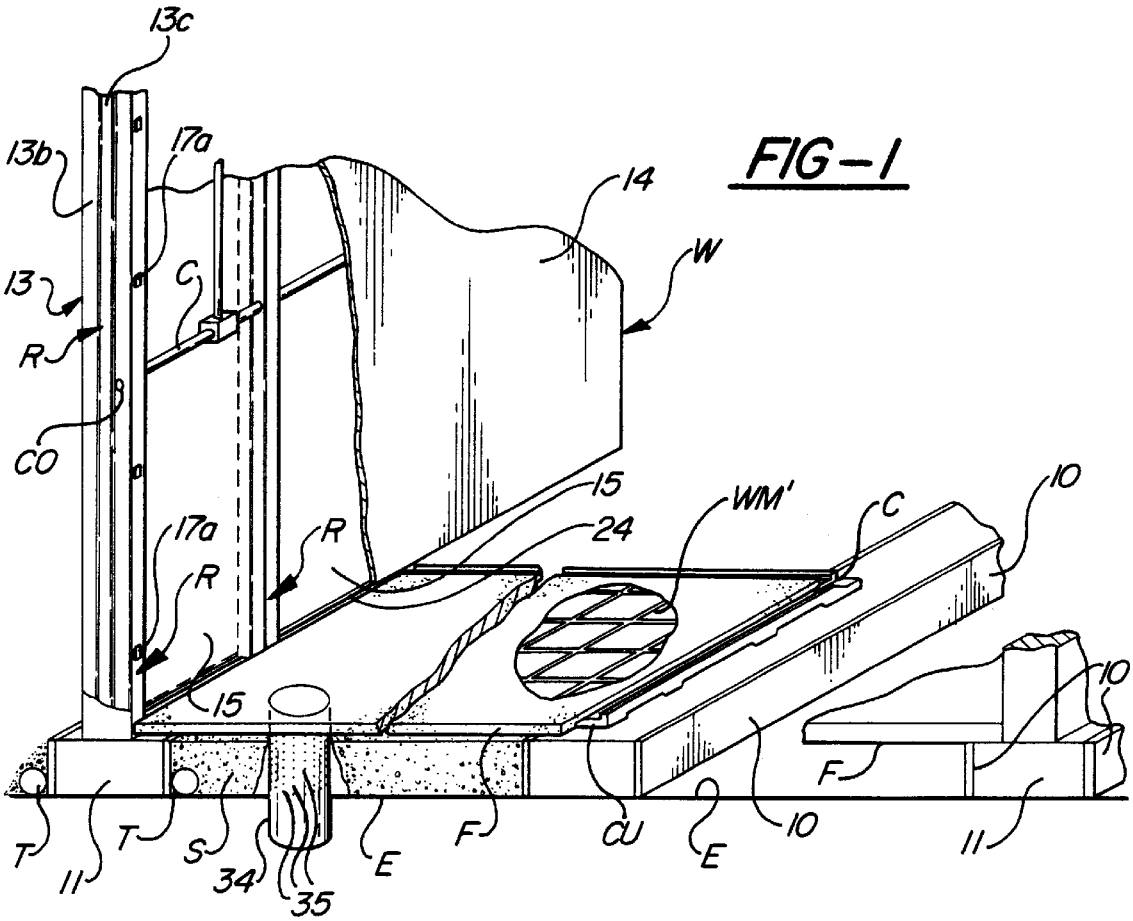
FIG-1
FIG-2
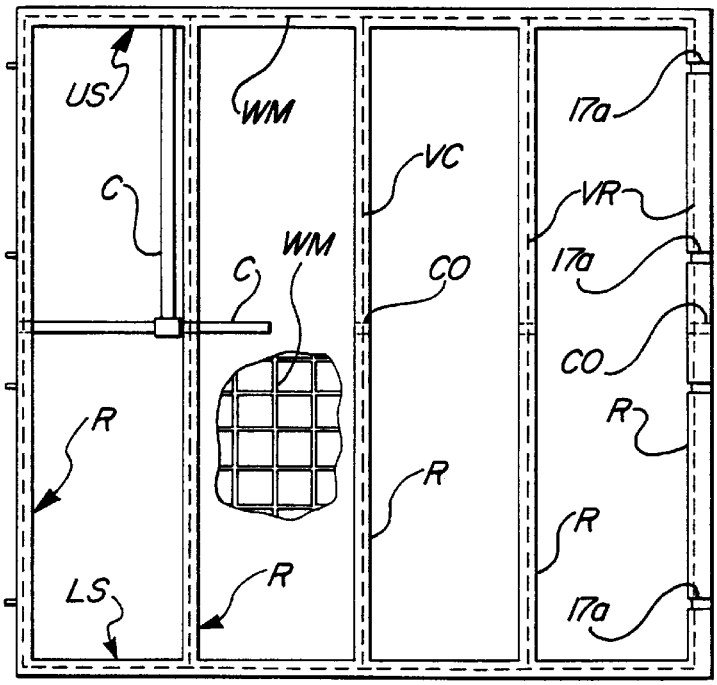

FIG-3
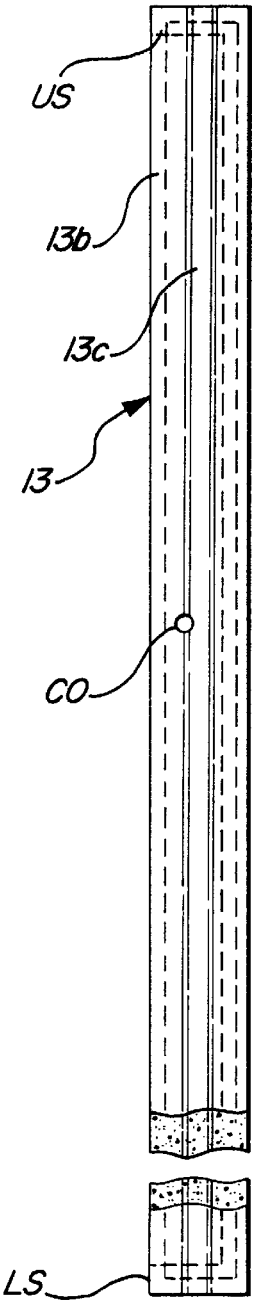
FIG-4
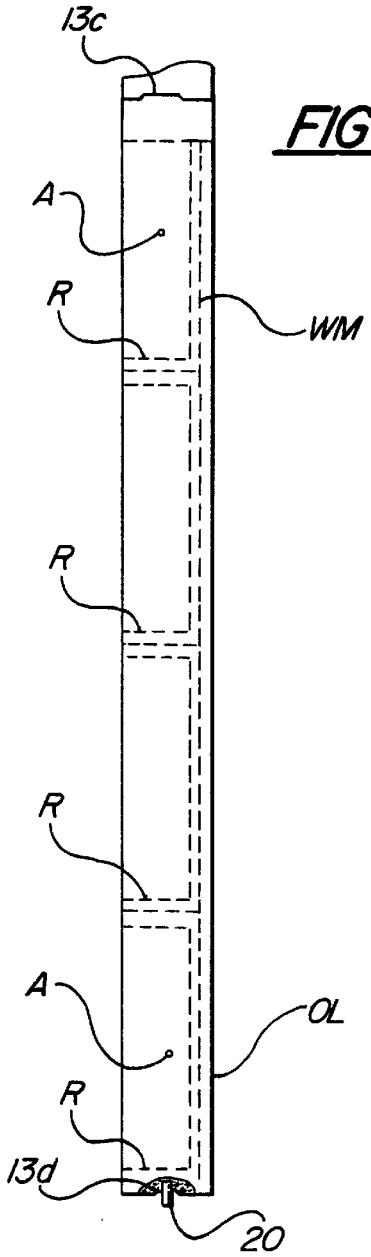
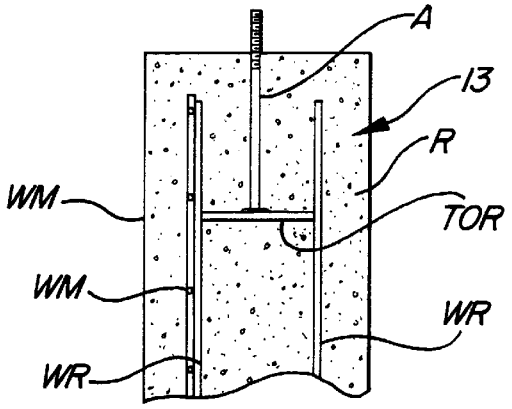
FIG-5

PREFABRICATED MODULAR CONCRETE FOUNDATION WALL SYSTEMS AND METHODS OF CONSTRUCTING PREFABRICATED MODULAR CONCRETE FOUNDATION WALL SYSTEMS

BACKGROUND OF THE INVENTION

The present invention deals generally with the construction of building foundation structures and walls, and more particularly with the erection of foundation systems which employ concrete prefabricated modules or panels, which are constructed at the factory, brought to the site of construction, and then coupled in tightly locked, sealed relationship. Basement and crawl space construction today, for the most part, involves the laying up of many courses of foundation block to provide vertical walls, or the construction of forms in the exact shape of the walls, into which a concrete mix is poured. Either of these most generally used methods of constructing foundations or basements is labor intensive, time consuming, temperature dependant, and therefore expensive.

More recently, in order to overcome the shortcomings of conventional methods of construction, prefabricated basement walls have been proposed, and are finding some use in construction.

SUMMARY OF THE INVENTION

The present invention is concerned with a building structure to be used principally as a basement or other subterranean enclosure, and includes the construction of a footing surface or surfaces arranged in a predetermined orientation to provide an enclosure of predesignated configuration when the prefabricated reinforced concrete wall parts or panels are set in place upon the footing surface and connected together in locked sealed relation. The fully reinforced prefabricated concrete panels contemplated incorporate insulating material covered by dry wall paneling with provision made for accomplishing electrical wiring and locking the panels to one another.

The concrete wall shell-like panels or parts are provided in generally longitudinally oriented abutting relation to form a vertically extending wall, and have respective projection and recess end sections which are received and locked in wedge-nested relation. Each of the wall sections or modules has embedded, longitudinally projecting steel lock parts on one edge integrated with the overall steel reinforcement utilized in the panel and embedded steel lock part receiving cam lock assemblies on the other, also integrated with the overall steel reinforcement utilized in the panel to provide maximum resistance to buckling pressures. Manipulatable actuators are then accessible through the interior walls of the panels for operating the cam-lock or camming assemblies to cam the panels into a wedge-locked sealed relationship. At each corner of the building structure, a right angle-shaped corner post is utilized which has lock parts on one end edge and a camming assembly on the other end edge to lock to adjoining panels. A similar post, to be more particularly described, is utilized where an interior basement wall is to be joined to an exterior wall.

In constructed condition, the basement or foundation walls erected at the site comprise segmented, studded concrete walls with fully integrated metal rebar and metal lock part and cam assemblies, which, all taken together, can be described as a continuous, interior reinforcing steel system extending throughout the overall foundation wall. The actuators for operating the camming assemblies do not protrude from the studs, and the insulation material is provided between the studs and does not require a piercing of the insulation to make them accessible. The construction facilitates the installation of wire carrying conduits extending horizontally in the concrete panels between the insulation and dry wall paneling, through which electrical wiring can be snaked in the usual manner.

Typically, the precast full basement size panels delivered to the site, which will have the insulation, aligned openings to receive the wire carrying conduits, and the dry wall all included, will be 8 foot by 8 foot 2 inch, or 8 foot by 9 foot 2 inch, panels with concrete studding incorporated. For basement crawl space foundations, the panels may be 8 by 4 foot panels. The pre-fabricated concrete floor, which is also installed at the building site, is comprised of modular, steel reinforced floor sections with precast lap edges and grooved receiving edges coupled in sealed relation, and, appropriately, will include embedded vertical pipe sections permitting access to the area beneath the floor for communications with a sump pump, and/or a pump for removing radon or other gases requiring removal. Special panels for the installation of window or door frames, or to accommodate I beams, are contemplated to be provided.

In forming the footings, preferably concrete form boards, which are also cast in the plant and delivered to the construction site, are utilized when the fast setting concrete footings are poured. These concrete form boards can be simply left in position so that it is unnecessary to come back and remove them.

One of the prime objects of the present invention is to provide an improved method of constructing prefabricated, modular, concrete basements or foundations with improved wall modules which provide, it is believed for the first time, an overall continuous interior steel reinforcement system for coupled concrete module segments. The novel system is designed to replace prior art modular concrete steel walls with studs which are connected by bolts which extend parallel to the wall from the end wall or stud of one panel through the adjoining end wall or steel of an adjoining panel such that any dry wall paneling must be provided on site after the wall is erected and cannot be factory installed.

A further object of the invention is to provide a modular, concrete wall structure for turnkey basements and other uses wherein the insulating and dry walling is all accomplished at the factory in a most economical and efficient manner, and the modules can be delivered to the site for erection with all of its basic construction requirements incorporated.

Still another object of the invention is to provide a strong, waterproof exterior wall structure of the character described which is easy to erect and interlock rapidly, from the interior of the wall system being erected, with far less labor cost and time involved.

Still another object of the invention is to provide a method of construction wherein the interlocked wall and floor structures constructed are all well sealed and reliably resist the foundation wall buckling forces which may be encountered.

Still another object of the invention is to provide a basement structure wherein the floor of the basement is constructed of factory-fabricated interfitting sealed concrete floor modules, providing a most economical and highly reliable floor construction which can be installed at the building site.

Still another object of the invention is to provide turnkey basement systems which meet all building codes for any new residential construction at great savings, and particularly manufactured housing foundations.

Still another object of the invention is to provide a process for constructing environmentally safe basement systems wherein nearly all of the building process can be accomplished in a factory in a single pour and in a controlled environment so weather delays and scheduling problems between multiple contractors are eliminated.

Still another object of the invention is to provide a highly reliable foundation building process having year-round capability, which produces steel reinforced concrete walls which are stronger than conventional block walls, and do not have the cracks and leaks which are frequently encountered with conventional poured walls.

An other object of the invention is to provide an integrated foundation structure of the type described which does not have settling problems and provides an excellent seismic base for use in geographic areas which are prone to earthquake activity.

Still a further object of the invention is to provide prefabricated insulated wall module shells which meet or exceed all existing building codes, and provide a dry wall interior surface which is ready to finish, or is finished.

Still a further object of the invention is to provide a modular system which incorporates factory-produced electrical wire conduit passages in its studs and sills and, once erected, is ready and easy to wire with safety.

Other objects and advantages of the invention will become apparent with reference to the accompanying drawings and the accompanying descriptive matter.

THE DRAWINGS

In the drawings:

FIG. 1 is a schematic perspective elevational view illustrating a foundation system constructed in accordance with the invention, with structural portions broken away to better illustrate various components of the system, some components not being illustrated, or fully illustrated, for the sake of simplicity of illustration;

FIG. 2 is an interior face elevational view of one of the studded concrete modules as precast, prior to the factory installation of insulation board, wiring conduit and drywall;

FIG. 3 is an end elevational view thereof;

FIG. 4 is an under plan view thereof;

FIG. 5 is an enlarged fragmentary sectional elevational view of the upper end of the panel;

DETAILED DESCRIPTION OF THE DRAWINGS

Figure 7:
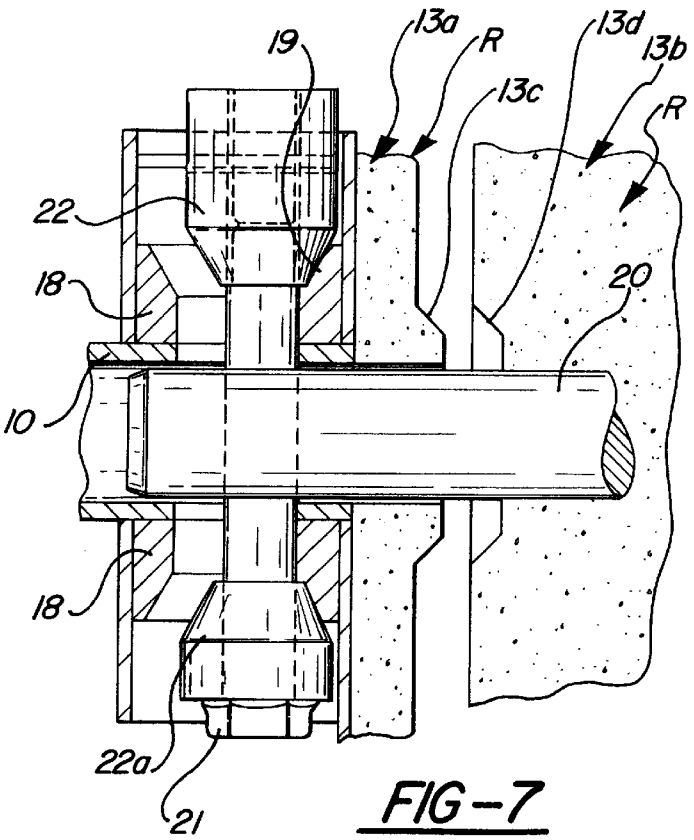
FIG. 7 is a top plan view similar to FIG. 6 showing the interlocking mechanism in unlocked position.

Referring now more particularly to the drawings, and in the first instance to FIG. 1, wherein a preferred embodiment of the invention is disclosed, it is to be understood that the concrete form boards 10 are cast at the factory and installed in position so that the concrete footings can be cast on the job, and the form boards 10 left in position. The excavated earth level is shown at E and, at the time the form boards 10 are placed in position, a layer of pea stone aggregate S is installed, as are the footing surrounding drain tiles T.

Once the footings 11, with appropriate steel reinforcement members in position, are poured and cured, the site is ready for the installation of the modular floor or floor system or assembly, generally designated F, with its floor modules or segments generally designated 12, and for installation of a composite wall structure or system, generally designated W, which is comprised of modular wall sections, segments, modules or panels 13 in the form of shells having dry wall paneling 14 covering insulation boards 15 which fit between the concrete end and interior studs or ribs R of each modular wall panel. The studs or ribs, including the end studs or walls R, project inwardly from the reinforced concrete outer walls OW of each shell and are connected by similarly projecting upper sills UL and lower sills LS. It is to be understood that the steel wire mesh reinforced floor modules 12 and the steel mesh reinforced wall modules 13 will be more particularly described later.

Figure 6:
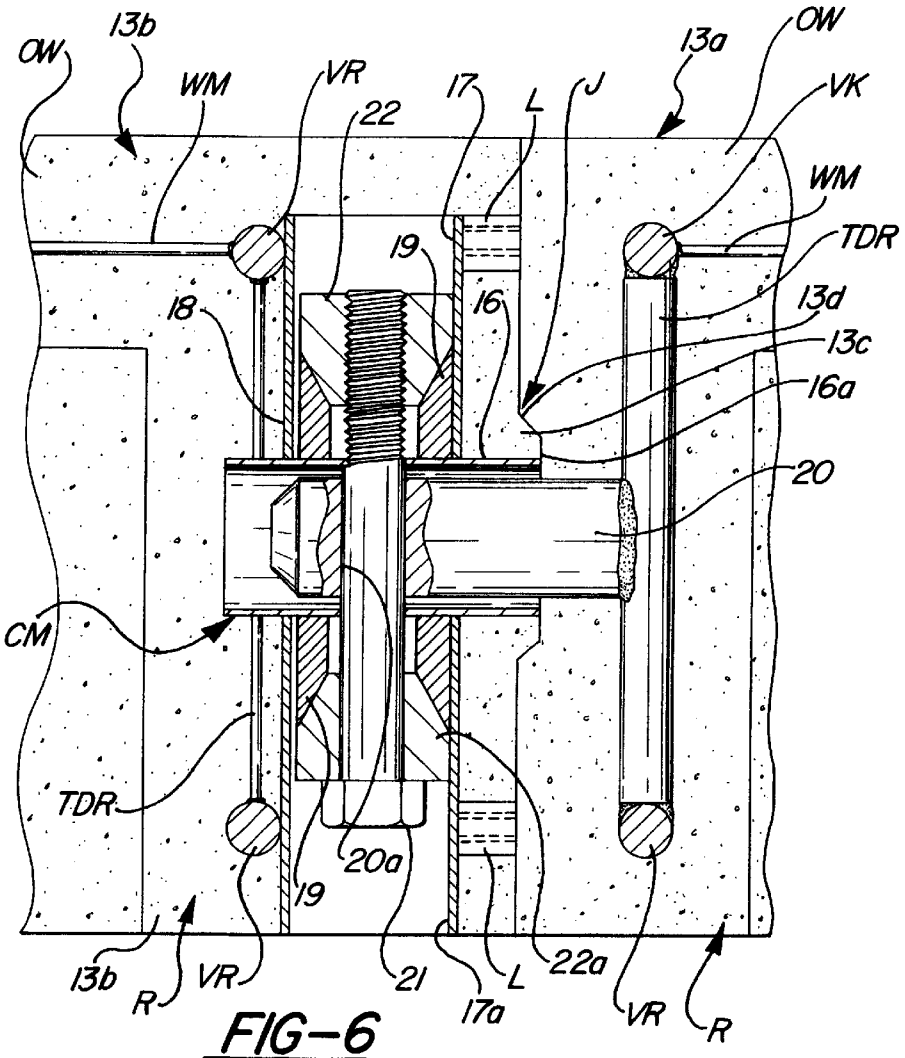
FIG. 6 is an enlarged, fragmentary top plan view illustrating the manner in which the abutting wall sections are interlocked.
Figure 9:
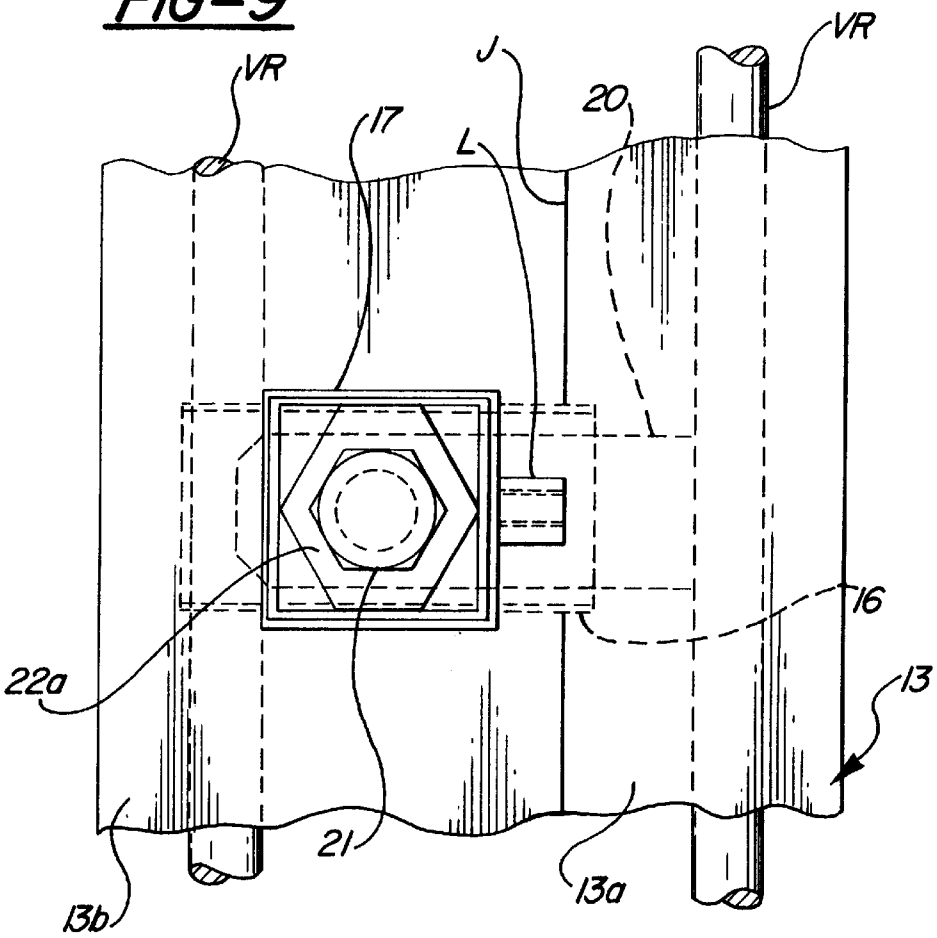
FIG. 9 is an enlarged, fragmentary, interior face elevational view illustrating the locking actuator access.
Figure 8:
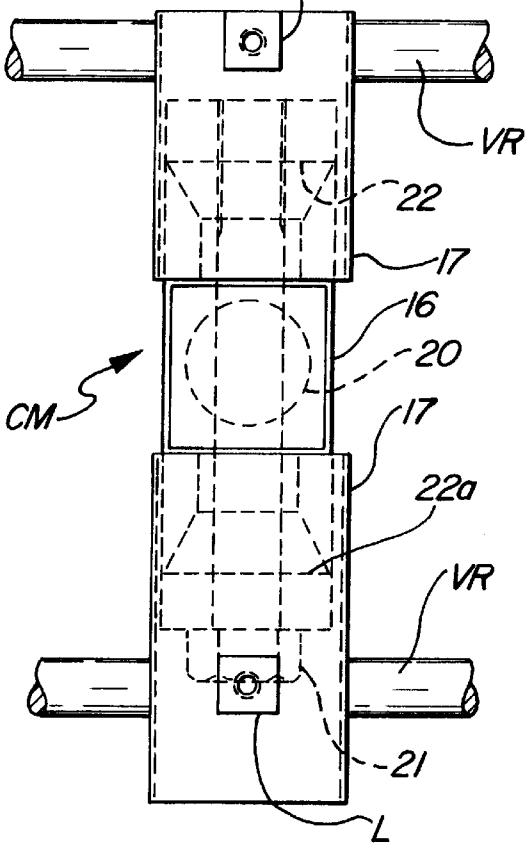
FIG. 8 is a side elevational view of the interlocking mechanism only.

It is further to be understood that the wall panels 13 are connected and interlocked by mesh integrated wall connector or locking assemblies, generally designated WC, as shown more particularly in FIGS. 6–8. In FIGS. 6 and 7, an interlocking structure for abutting panels is disclosed in which it will be noted that there is a wedge-shaped tongue and groove joint, generally designated J, provided in the abutting wall panels or shell segments 13*a* and 13*b*, the panel 13*a* having a vertically extending tongue portion or wall section end 13*c* and the panel 13*b* having a vertically extending recess portion or end 13*d* in an endmost wall section of panel 13*b* for receiving the tongue portion 13*c*. In FIG. 7, the panels 13*a* and 13*b* are shown in a slightly separated position, ready to be interlocked.

The wall panel interlocking construction here includes a series of wedge-retained interlock assemblies or mechanisms generally designated WC, of a type now to be specifically described, used in vertically spaced relation with abutting wall panels or shell segments 13. Typically, four mechanisms WC are employed in vertically spaced relation as indicated in FIG. 2. In FIGS. 6 and 7, the panel 13*b* is shown as having a lock part comprising an embedded, horizontally longitudinally disposed sleeve or tube 16 opening through the end of panel 13*b* and tongue 13*c*. The sleeve 16 is intersected by an embedded horizontally disposed tube 17 at right angles to it, which is open at one end 17*a* through the end stud or wall of the panel 13*b*. Provided within sleeve 17, but not fixed to it, is a sleeve 18 having tapered piloting and wedging surfaces 19 at each end interiorly. The tubes 16, 17 and accompanying components to be described may be referred to as camming mechanisms or assemblies CM which are provided as a series of vertically spaced structures or lock parts. A series of complemetally vertically spaced lock pins or parts 20 each constitutes a locking projection or lock part embedded in wall 13*a* and projecting longitudinally endwisely therefrom. Each lock part 20 extends, as shown in FIG. 4, into one of the tubes 17. Each locking projection 20 has a cross opening 20*a* within which an actuator member or cam pin 21, such as a bolt, is snugly insertable, and it will be seen in FIGS. 6 and 7 that bolt 21 has spaced apart conically configured cone-shaped members 22 and 22*a* mounted on its ends to engage the tapered surfaces 19. One of the cone shaped members is a threaded nut 22 to coact with the bolt threads and the other 22*a* is simply a piloting member freely received on the bolt shank. The actuator bolt 21 is accessible through the opening 17*a* and, when tightened down from the FIG. 7 to the FIG. 6 position, draws the wall or segments or panels 13*a* and 13*b* into the wedge locked position shown in FIG. 6 bearing against the interior marginal wall of sleeve 17 at its endwisely outer side. It is to be understood that a bead of adhesive sealing mastic M is typically preprovided on the wall ends 13*c* and 13*d* so that, when the wall segments 13*a* and 13*b* are drawn into interlocked relationship, the area around each tube projection or lock part 20 is completely sealed.

Vertically extending reinforcing rods VR are shown as welded to all tubes 17 and 20 and it is further to be understood that the rods VR are welded to the transversely horizontal extension rods TDR which are welded to the embedded wire mesh rebar structure or wall extending substantially from one end edge of each of the panels or segments 13 to the other in the outer or interior walls or wall portions OW of the shell panels. In addition, vertical rebar members VR are provided in each of the internal studs or ribs R and these are fixed to the wire mesh reinforcement W by a plurality of transverse disposed, vertically spaced reinforcement rods TDR, as shown in FIG. 5. FIG. 5 also illustrates the fixing of anchors to the steel frame of each segment 13 along its upper end. Vertical members VR are fixed to the ends of the wire mesh WM also to facilitate this. Typically, throughout the steel reinforcement network or frame, cross-rods or pins TDR of appropriate dimensions are used at three inch vertical intervals in the studs and may be discrete rods or provided in a mesh welded to the vertical rods VR. Thus, a complete and continuous welded rebar system provides an embedded steel skeleton frame or reinforcing network in each wall structure which is steel connected to the like system in the adjacent panel 13 by the steel joint locks WC to provide the integrated reinforcing network for the composite wall system. To assist locating the sleeves 17 and associated components during casting, locator lugs 1 are fixed to the sleeve 17 which cooperate with the mold in which casting takes place.

Figure 22:
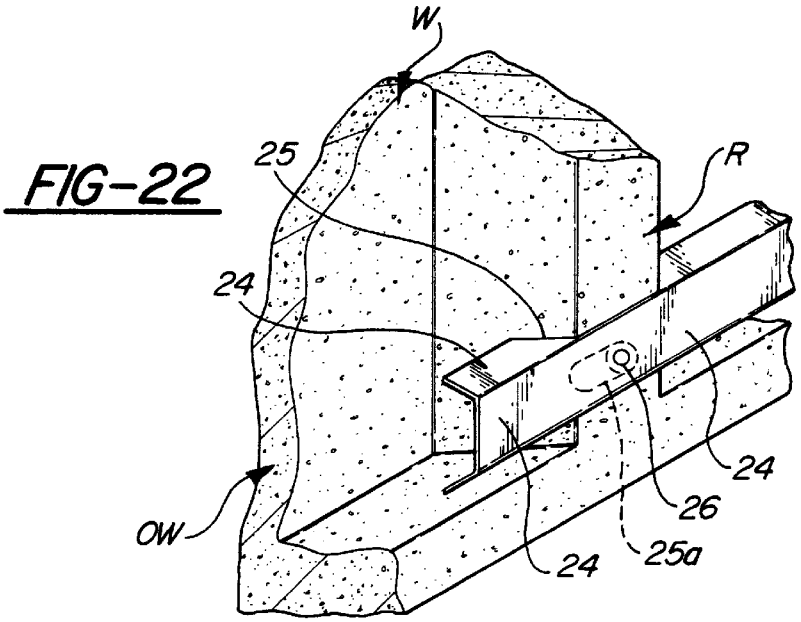
FIG. 22 is a schematic elevational view illustrating the manner in which the dry wall paneling is attached to each of the modules.
Figure 23:
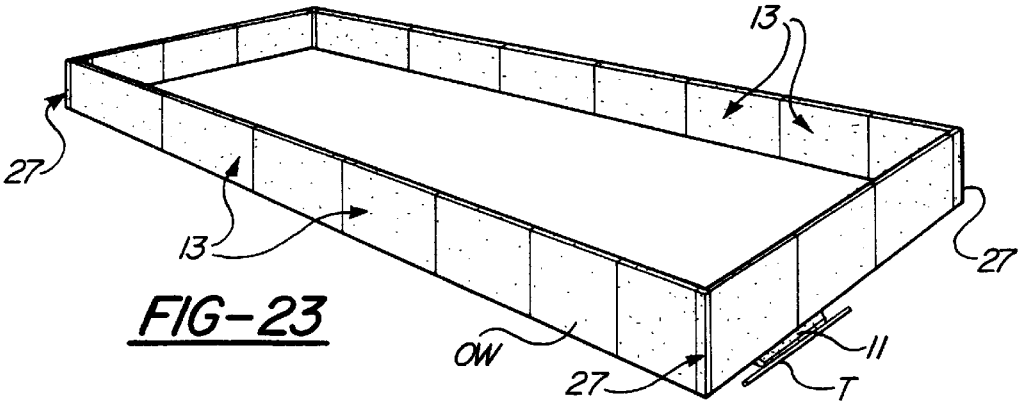
FIG. 23 is a schematic, fragmentary, perspective plan view showing a composite basement foundation.

Directing attention now to FIG. 22, it will be seen that metal dry wall furring strips in the form of channels 24 are provided to facilitate the attachment of the dry wall panels 14. These furring channels 24 are cut out as at 25 to snugly receive each of the concrete panel ribs R. Then, dry wall screws are used to extend through openings 26 formed in the channels 24 into threaded enclosure sleeves 25*a* cast in the ribs R to hold the furring strips 24 in place when the dry wall panels 14 are secured over the ribs R.

Figure 10:
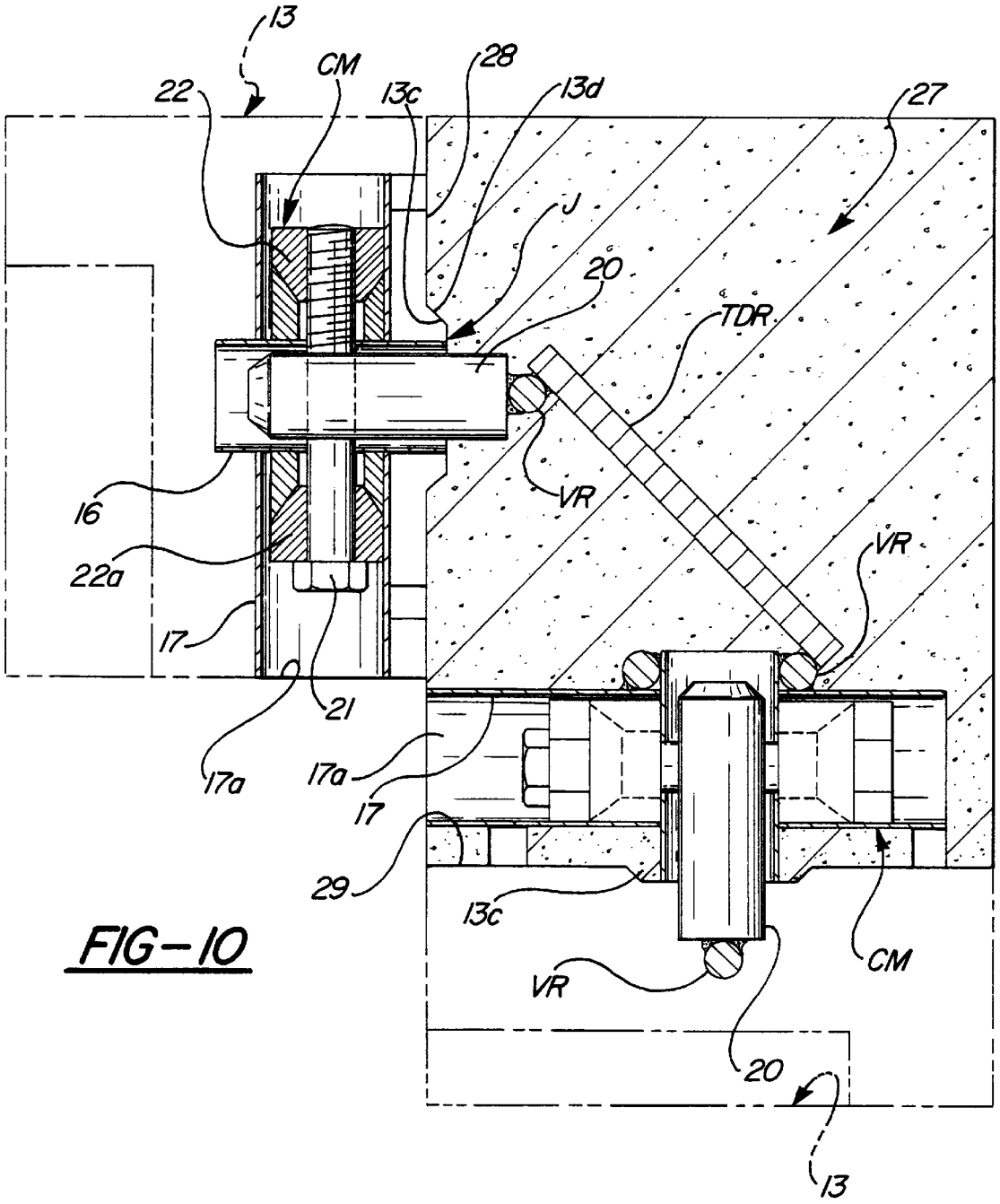
FIG. 10 is an enlarged, fragmentary, sectional plan view of a corner post which is used at the juncture of perpendicularly oriented exterior wall modules.
Figure 11:
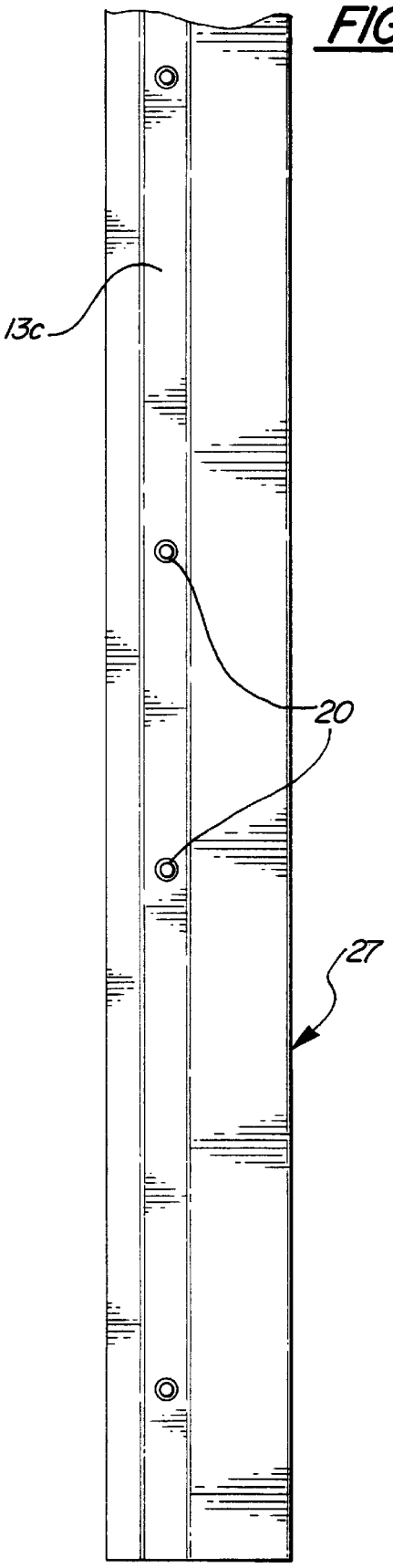
FIG. 11 is an end elevational view of the corner post on a reduced scale.
Figure 12:
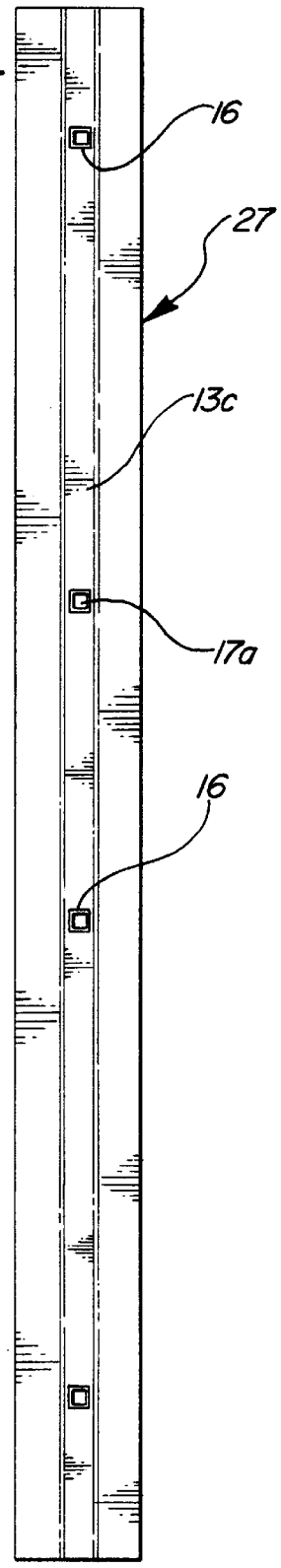
FIG. 12 is a vertical elevational view of the corner post taken from another side.

As shown in FIG. 10, concrete wall posts members, segments, or sections 27, which are also manufactured at the factory, are utilized at the wall corners. Each of the ends of the wall corners is provided with interlock componentry WC with the same camming mechanism, generally designated CM, and the same projecting lock part or member 20, extending from the perpendicularly disposed end faces 29 and 28 of the solid concrete corner post 27.

The end portion, or face 28 is provided with a recess 13*d* to receive the tongue 13*c* on the adjoining concrete shell segment 13 and the end portion or face 29 is provided with a tongue 13*c* to receive the recess 13*d* on the adjoining concrete shell section 13. Vertical rebar rods VR embedded in the post 27 are welded or connected by vertically spaced transverse reinforcement rods TDR to provide the integrated embedded steel network.

Figure 13:
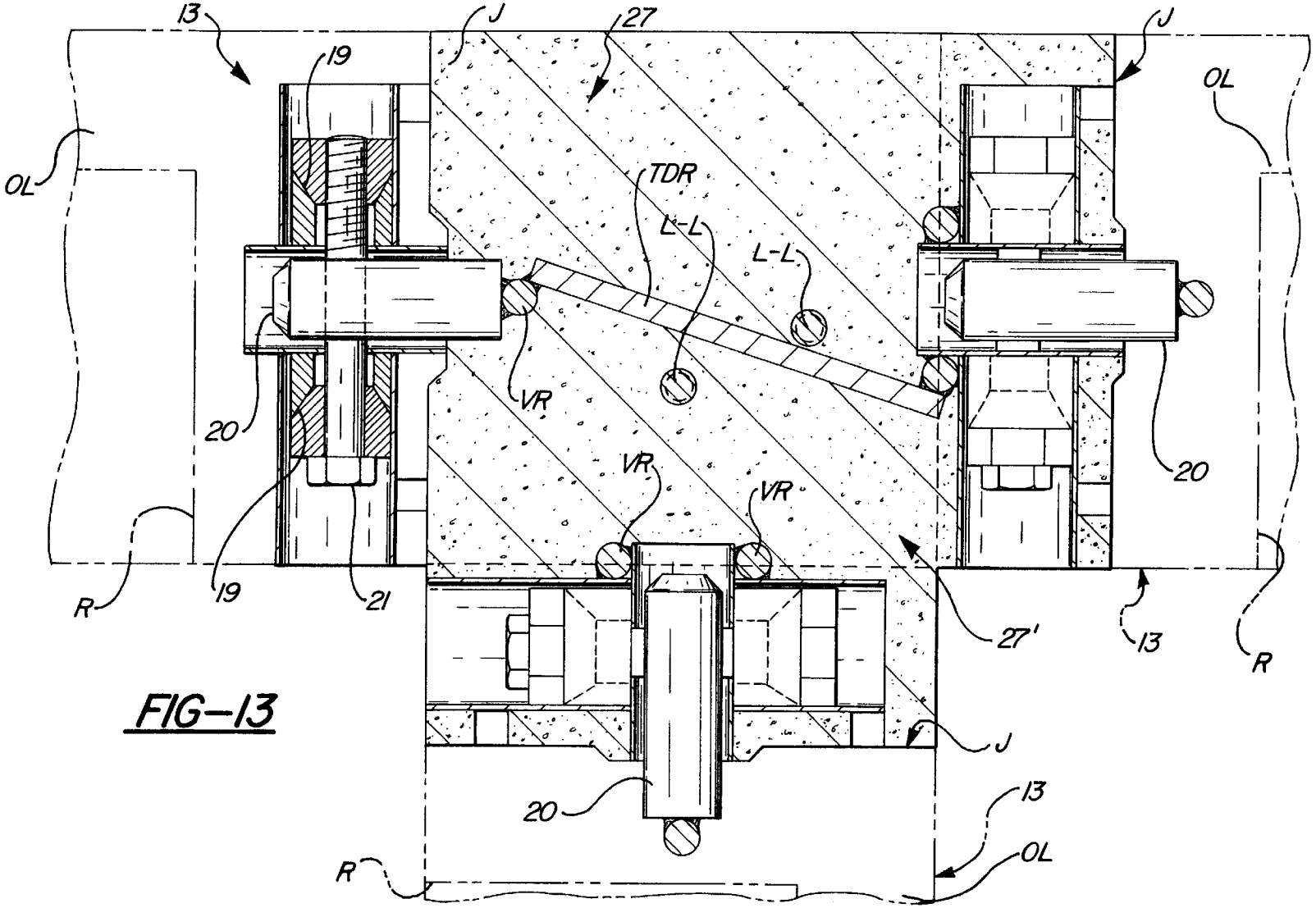
FIG. 13 is an enlarged, fragmentary, sectional plan view of a modified corner post used when an interior wall segment is to be coupled to in line exterior wall modules.
Figure 14:
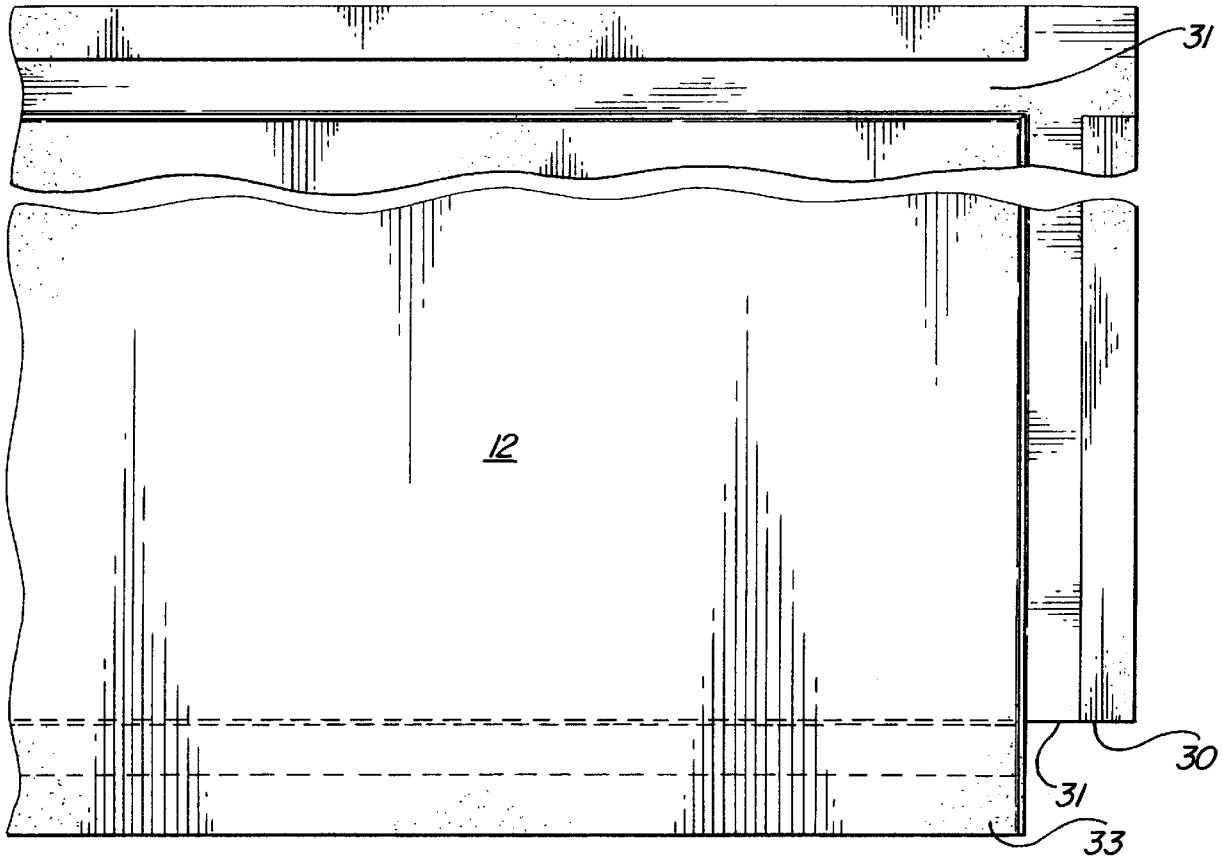
FIG. 14 is a fragmentary top plan view of one of the interlocking floor panels.
Figure 15:
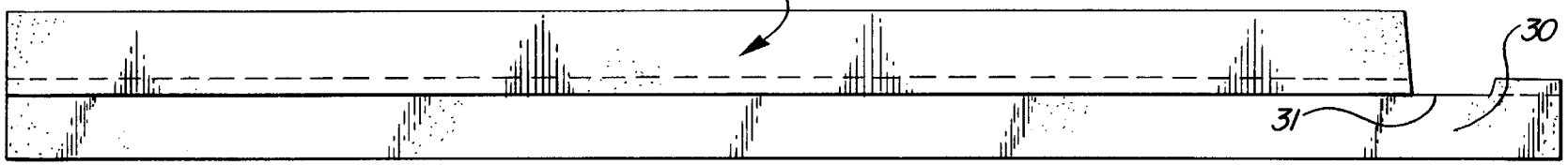
FIG. 15 is a side elevational view thereof.

When an interior basement wall is to be joined to an exterior wall the corner wall posts 27' are utilized to provide tri-locking faces utilizing the same interlock componentry WC as shown in FIG. 13. In the case of both the posts 27 and 27', lifting lugs L—L may be cast in place as shown in FIG. 3 to facilitate handling.

The floor modules 12 are constructed with lower reduced jointing edge portions 30 having inset grooves or keyways 31 for receiving the overlapping reduced upper jointing edge portions 32 of adjoining modules 12. The edge portions 32 have vertical keys 33 which are received in the keyways 31 and the edge portions 30 have keys 31*a* which interfit with keyways 33*a*. The jointing edge sections 30 can be easily split off to abut wall modules 12 to fit flush with the wall panels 13 and the corner posts 27 or 27'. As FIG. 21 also indicates, the sides and ends of the floor modules are provided with edge portions 30 and 32, dependant on the position of the particular panel in the floor, and where necessary the edges 30 are cut away as at CU to permit the interface, or the edges 32 are underlaid with a grout to permit edges 32 to more firmly abut the walls 13. Usually typical commercial water sealant, which is also adhesive in nature, is provided, not only between the keys and keyways but also at the joints between the floor panels 12 and wall components 13, 27, and 27' to insure a tight waterproof seal. Wire mesh WM' is also embedded (cast in) to extend almost end to end and side to side in the floor panels 12, and floor reinforcement bars which extend in the edge sections 30 and 32 in a manner to be described are welded to the mesh WR' prior to floor panel casting.

Figure 16:
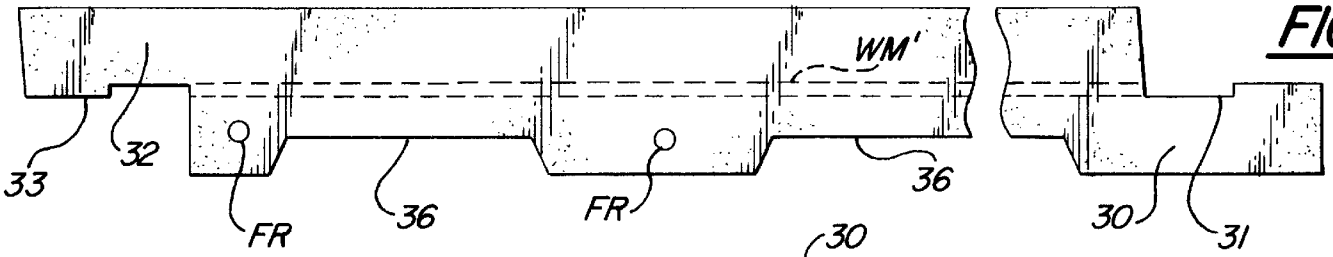
FIG. 16 is an end elevational view thereof.
Figure 17:
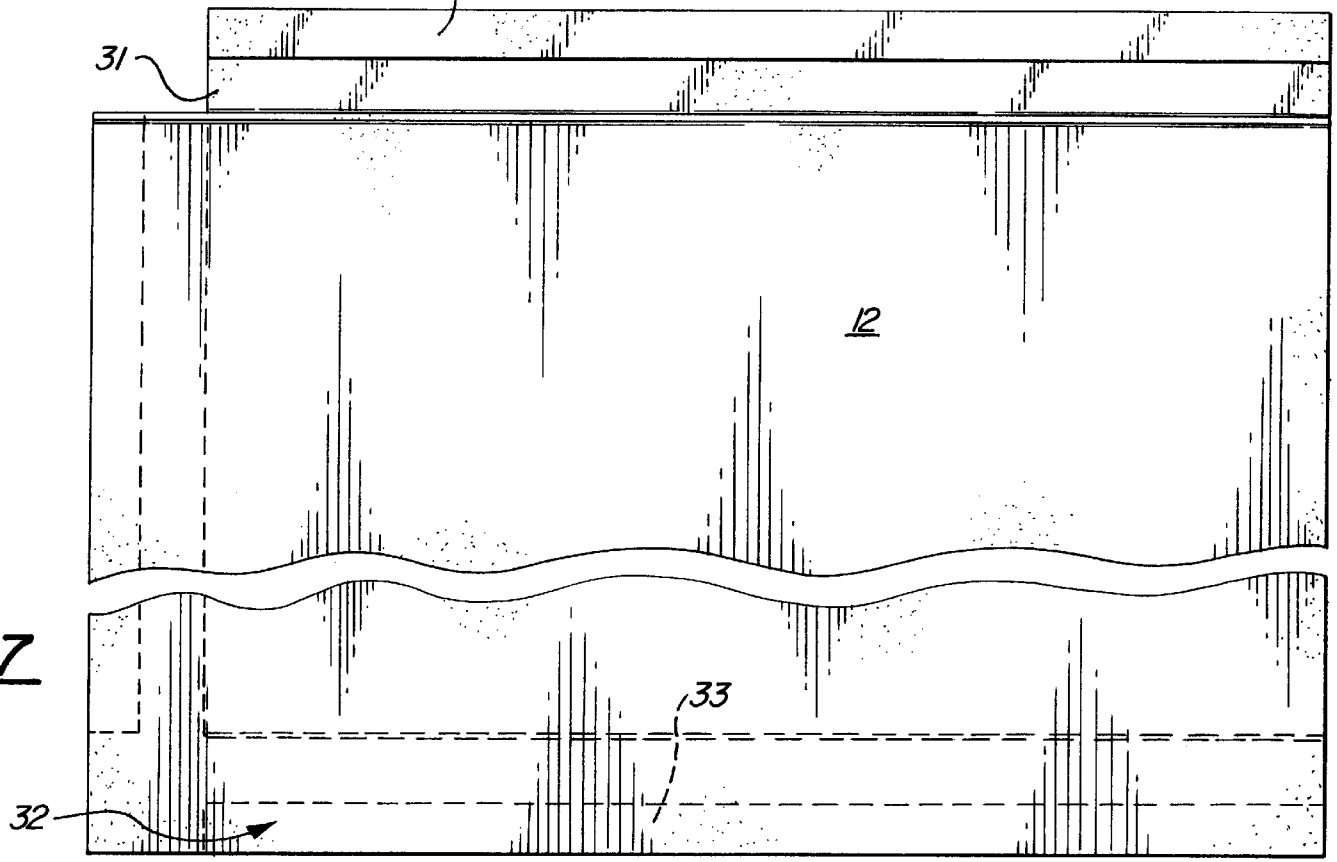
FIG. 17 is a top plan view of an adjacent floor panel with steel reinforcement omitted.
Figure 18:
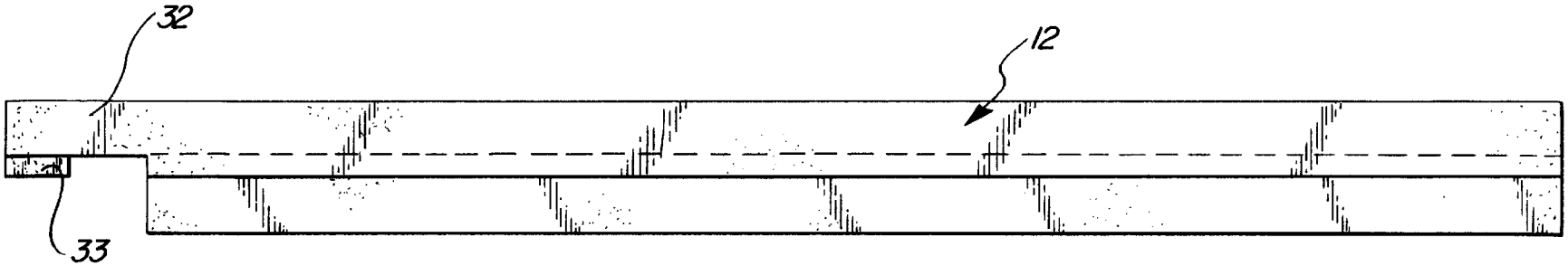
FIG. 18 is a side elevational view thereof.
Figure 19:
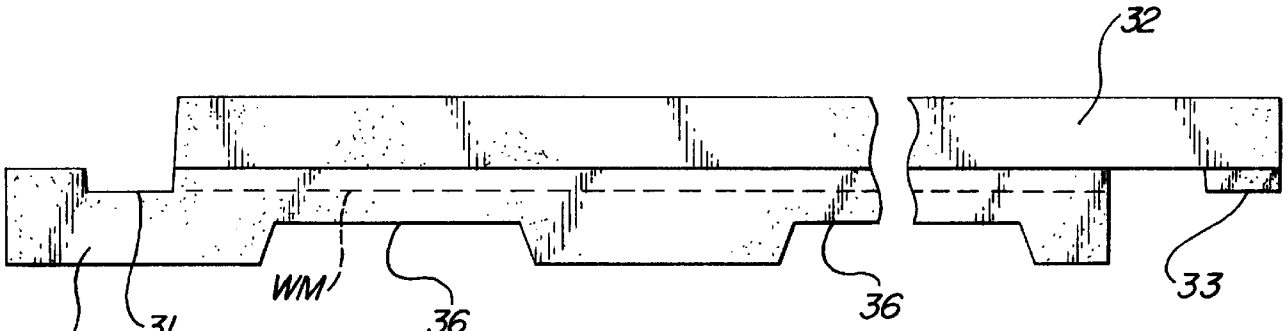
FIG. 19 is an end elevational view thereof.

Also, a sump pump and radon gas collector tube 34, provided to extend downwardly from a floor module 12, extends through the aggregate layer S and into the earth E. Openings 34*a* provided in the tube 34 permit the flow of liquid and/or gaseous radon up into the tube 34 which can, at its upper end, be closed by an air suction pump housing or by a sump pump housing, or a combined version thereof. The floor panels 12 are formed with radon gas collection channels 36, as shown in FIGS. 1 and 16 particularly. FIGS. 1, 14–20, and 21 particularly illustrate how the various floor panels are configured to interfit and form the overall floor F.

THE PANEL FABRICATION AND COMPOSITE WALL ERECTION

Figure 24A:
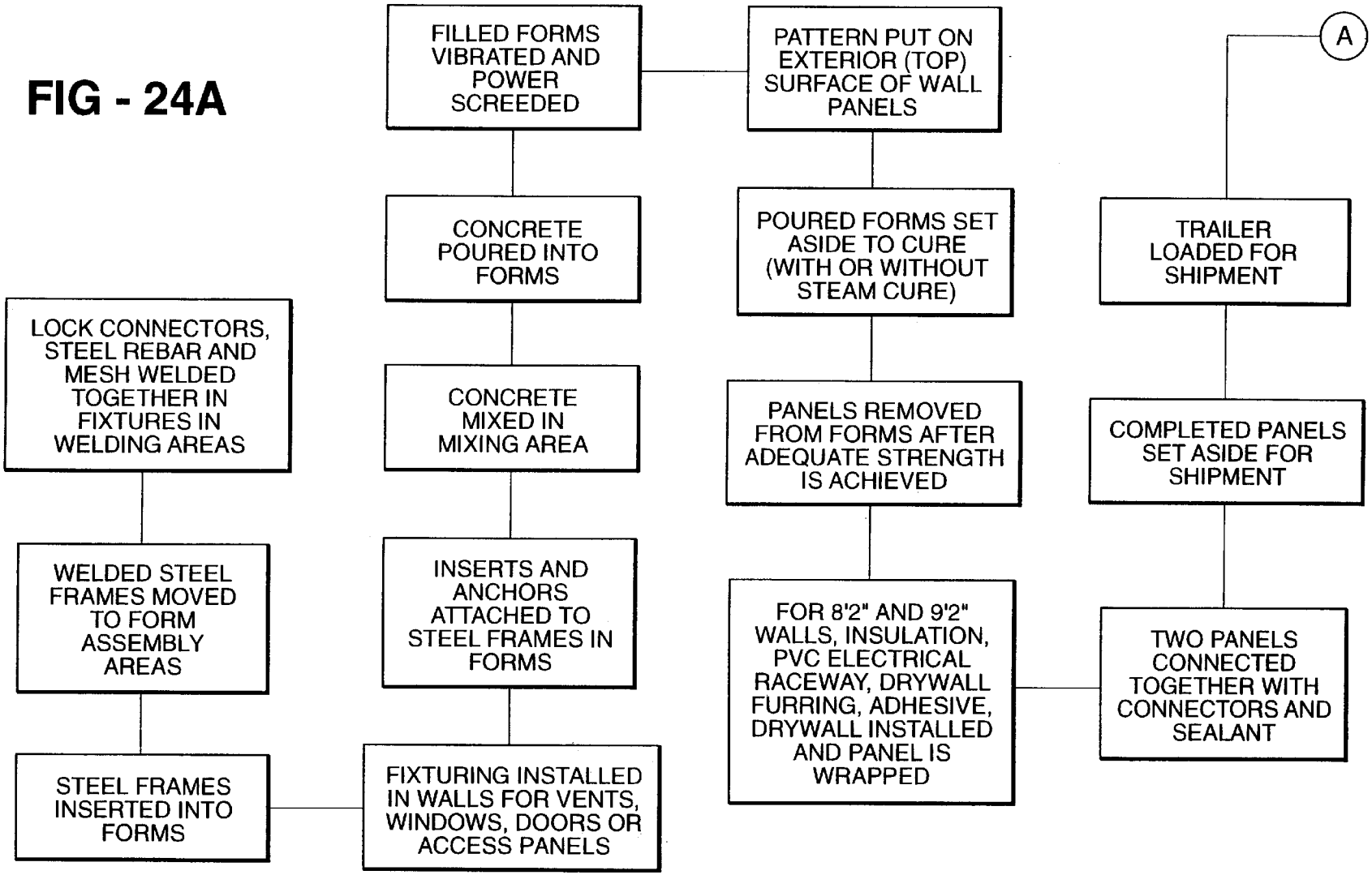
FIGS. 24A and 24B are line diagrams defining steps involved in the methods described.
Figure 24B:
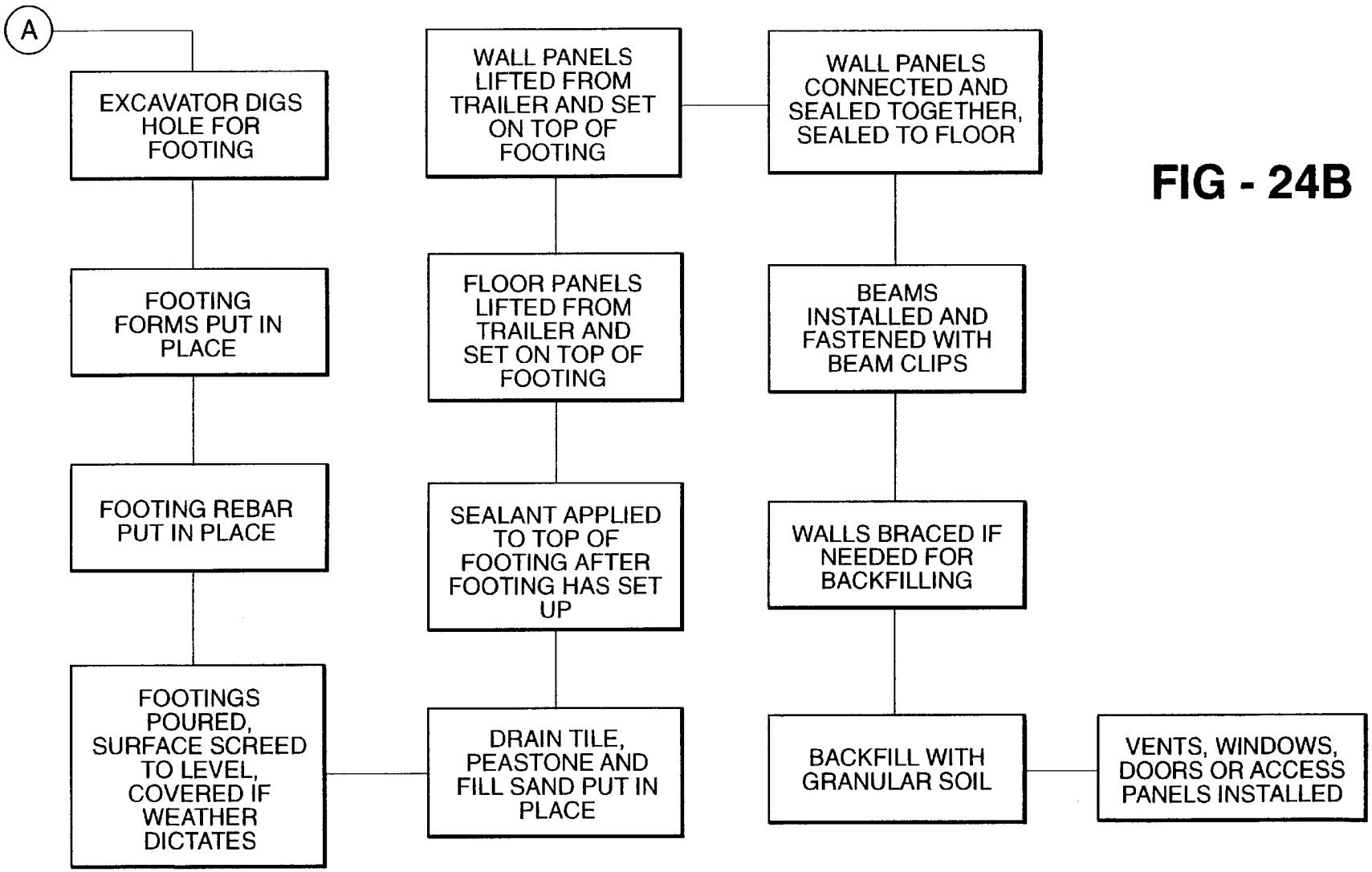

The various steps performed in fabrication and erection are set forth in FIGS. 24*a* and 24*b*. The concrete wall panels or segments 13 are contemplated to be cast of a commercially available cement mixture with commercially available xypex additive as a waterproofing agent. The composition of the concrete forms no part of the present invention. Casting takes place in forms or molds which, prior to the pour, are supplied with and support the skeleton network made up of the wire mesh or mesh reinforcing wall WM and all attached reinforcement bars VR and TDR together with the components of the interlock wall connector assemblies WC, all being directly or indirectly appropriately welded to the wire mesh WM as illustrated. The molds or forms further support the spacers which form openings CO in the ribs or studs R for the later inserted wiring conduits C in their requisite positions and provide for the casting of the vertical ribs or studs R and the upper and lower sill sections US and LS, respectively.

They also support the plastic sleeve anchors 25*a* which are cast in the ribs R so as to be open to the faces of studs R to facilitate dry wall furring strip attachment. Once the wall sections 13 are cast to embed these various components in place in the concrete, insulation board is placed in position between rib R and the conduits are installed secured in place through the openings cast in the ribs R and sills US to pass them. Securement of the insulation board can be accomplished with fasteners of a suitable nature which are commercially available. Typically, the insulation will be a foam board, such as Styrofoam, or a so-called bead board. The conduit C may include PVC piping and appropriate junction boxes (as shown in FIG. 1), with the conduits being open at 23 through the end walls or end studs of the panels 13 for the introduction of wiring.

The next step involves the attachment of the dry wall furring strips or channels 24 of the character identified in FIG. 22 to the upper and lower ends of the panels 13 at the level of the upper and lower sills US and LS. As FIG. 22 shows, the furring strips 24 will be vertically offset somewhat from the lower and upper edges of the sills. The dry wall panels 14 to be then applied may be vinyl-covered dry wall which provides an attractive interior face for the wall system W. Prior to application, the dry wall board 14 will be cut to provide openings 17*b* for the ends 17*a* of actuator access tubes 17. In addition to using fasteners to secure the furring strips to the plastic anchor sleeves cast in the ribs R and upper and lower sills, dry wall adhesive is applied to the exterior faces of all ribs R and sills US and LS, as well as to the exterior faces of the top and bottom metal furring strips 24. Dry wall fasteners are used to secure the dry wall to the furring strips.

The concrete panel may be delivered to the building site along with like panels 13 which have been factory fabricated and the appropriate corner posts 27 and 27' which have been fabricated in the same manner in appropriate forms. In these corner forms, again the componentry of the locked joints WC are supported in the form in proper position for the casting to take place, as are the reinforcement bars VR and TDR which are welded to the components of joints WC and used in the concrete as disclosed in FIGS. 10 and 13.

Figure 20:
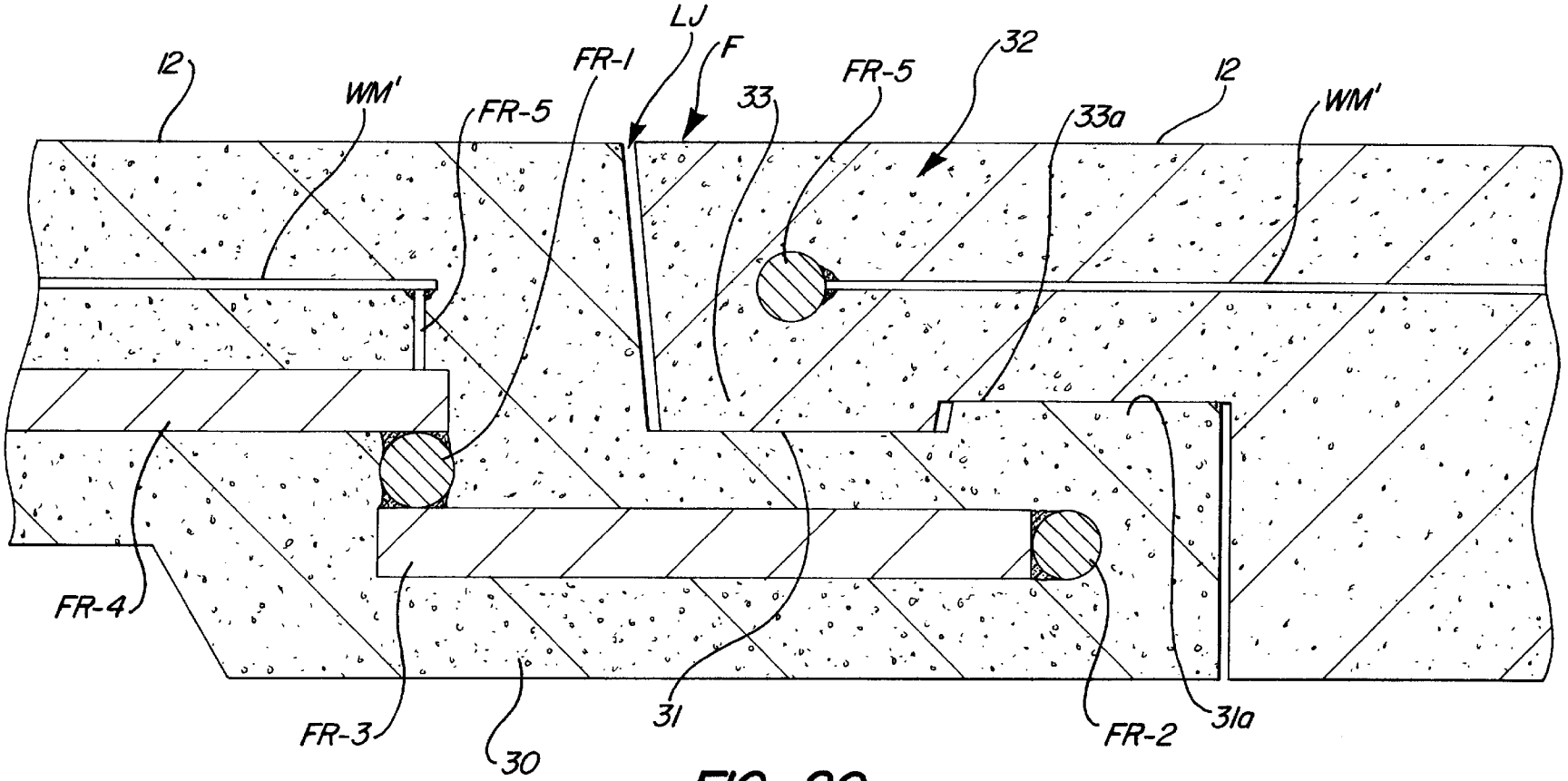
FIG. 20 is an enlarged fragmentary sectional elevational view illustrating the floor panel interlock joints to illustrate the manner of steel reinforcement thereof.
Figure 21:
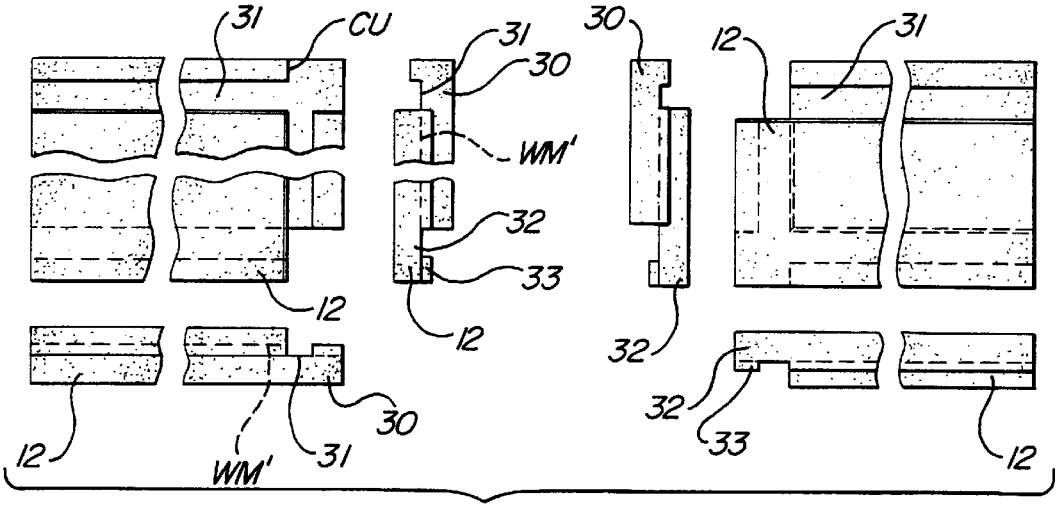
FIG. 21 is a schematic composite of modified floor panels utilized in a typical floor comprised of left and right floor panels, each panel having plan, side elevational, and end elevational views, the steel reinforcement rods being principally omitted.

The floor panels 12, shown in FIGS. 1, 20, and 21 particularly, are cast in forms, with again, the wire mesh WM' or mesh wire in the main section of the floor panels and the various floor reinforcement bars FR-1 through FR-5 supported in the proper position for pouring of the concrete mixture to form the underlap and overlap lap edges 30 and 32, respectively, as shown in FIG. 20 particularly. Transversely spaced rods FR-4, which extend the full length of the panel parallel to mesh WM' and connect with it via vertical pins FR-5 at intervals, are connected by cross-rods FR-1 which weld to edge rods FR-3 in the lap edge 30. Rods FR-3 extend at transversely space intervals in the underlapping edge and are welded to the terminal transverse rods FR-2. Transverse rod FR-5 in the overlapping edge 32 is welded directly to the wire mesh wall WM in the adjoining floor panel. The floor lap joint LJ is appropriately sealed with an adhesive mastic.

Also prefabricated at the factory, as indicated, are the concrete footing form boards 10, which do not incorporate wire reinforcement. At the site, the preparation for basement erection has included a leveling of the excavation at the level E shown in FIG. 1, the installation of the form boards 10, the tiles T, the pea stone S, and the pipe 34. One of the floor panels 12 has been cast with a circular opening 34*a* which will pass the upper end of pipe 34.

After the concrete footings 11 have been poured and set, the next step is the installation of the floor panels 20 by way of interlocking them in the manner particularly disclosed in FIGS. 1 and 21. Sections of these floor panels are split off where necessary, such as to avoid having an open keyway along any of the wall panels 13. Again, as indicated, appropriate mastic of an adhesive nature is provided at the juncture of the floor panels and wall panels. Once the floor F and pipe 34 are in place, the various wall panels 13 may be lowered into position by means of a suitable crane or the like in a state of loosely abutting relationship, along with any corners 27 or 27' which are employed. In a case in which the building owner desires a poured floor, the pouring will take place after the wall is erected. In some instances several panels 13 or a panel and corner post 27 or 27' may be interlocked at the factory site prior to transporting them to the building site. A mastic bead applied to the upper face of the footing surface before the wall segments 13 are lowered into engagement with it, seals this surface.

With the footing form boards 10 remaining in place, the tiles T can be placed in position along with pea stone, while the concrete footings 11 are curing. With the adjoining concrete wall sections 13 in a position in which they are not locked as shown in FIG. 7 and the lock projections 20 received within the tubes 16, the actuator bolts 21 can then be inserted along with the outer cones 22*a*. The cone members 22 are already in place having been placed before the panels 13 are cast in the first place. Provision is made to keep the tubes 16 and 17 clear of the concrete mixture at the time of casting. Once the various bolt actuators 21 have been extended through the openings 20*a* in the lock projections 20, and threaded into the cone nuts 22, further threading of the bolts 21 draws the cones 22 and 22*a* together to tightly wedge them against the tapered surfaces 19 and wedge-lock the wedge-shaped tongue portions 13*c* in the wedge-shaped recesses 13*d*. In so doing, the walls 13*a* and 13*b* in FIG. 6 are physically drawn together by the cam action, the lock parts or connector pins 20 causing the walls 13*a* in FIG. 6 to be drawn toward the wall panel 13*b*. The camming assembly CM thus accomplishes not only movement of the wall panel 13*a* longitudinally, it also operates to lock the parts in wedged relation. Typically several of the actuators 21 will simultaneously be operated to relatively move the wall sections 13 in FIG. 6. The wall sections 13 are in this manner locked in wedged, sealed relation all around the wall W of the basement wall disclosed in FIG. 22, with appropriate adhesive mastic being used between the wall sections, as previously indicated.

Beam clips which have been secured to the wall sections may be used to fasten down the housing structure beams on the wall sections.

It is to be understood that the embodiments described are exemplary of various forms of the invention only and that the invention is defined in the appended claims which contemplate various modifications within the spirit and scope of the invention.

I claim:

1. A building structure comprising:

a. a footing surface arranged in a predetermined configuration;

b. end to end matching concrete wall segments, with interior and exterior surfaces and having endmost wall sections, disposed in generally longitudinally oriented abutting relation to form a vertically extending composite wall supported on said footing surface;

c. one of said wall sections on one of said wall segments having an embedded horizontally extending lock part, and the abutting endmost wall section on an adjoining wall segment having an embedded camming assembly receiving said lock part; and d. an accessible manipulatable actuator connected to manipulate said camming assembly to create relative movement of said endmost wall sections of adjoining wall segments into abutting relation.

2. The structure of claim 1 wherein said abutting endmost wall segments have respective projection and recess nesting sections received in nested relationship; said lock part and camming assembly are embedded in said respective nesting sections; and said actuator is housed in a tube open to the interior surface of one of said wall sections for manipulation purposes.

3. The structure of claim 1 wherein said lock part has an end portion which projects longitudinally from said wall section in which it is embedded and has a perpendicularly extending cam pin, with an axially adjustable frustroconical cam portion thereon, extending in a direction transversely of said abutting endmost wall section, said abutting endmost wall section having an enlarged diameter sleeve with an axially beveled piloting section receiving said cam pin to interact said cam portion and piloting section upon axial movement of said cam pin.

4. The structure of claim 3 in which said cam pin is a threaded member and said cam portion is threaded to be movable therelong on rotation of said cam pin.

5. The structure of claim 3 wherein said camming assembly has a housing extending longitudinally, which is intersected by said sleeve and open thereto, and said lock part end portion projects into said housing.

6. The structure of claim 5 wherein said sleeve is open to the interior surface of the wall section in which the sleeve is embedded and is interiorly beveled at both ends; and said cam pin has a cam portion at each end interacting with said bevels.

7. The structure of claim 1 wherein said lock part incorporates an inclined surface and said camming assembly has a cooperative complementally inclined surface which locks said lock part and camming assembly in wedged relation.

8. The structure of claim 1 wherein said actuator comprises a threaded member carried by said lock part and extending perpendicularly thereto.

9. The structure of claim 1 wherein said wall segments are abutting longitudinally aligned shell segments with upper and lower sills spanned vertically by longitudinally spaced studs.

10. The structure of claim 1 wherein said wall segments comprise a corner member and a panel.

11. The structure of claim 1 wherein a floor comprised of horizontally overlapping interlocking panels abuts to said wall segments.

12. The structure of claim 1 wherein said wall segments are shells with an outer exterior wall and interiorly projecting sill and stud structures comprising integrated concrete interior and end vertical studs joined by upper and lower sills, insulation is provided in said shells between the studs, and wallboard is provided as the interior surface of said shells covering said sill and stud structure and insulation, there being an opening in said wallboard providing access to said actuator.

13. The structure of claim 1 wherein steel reinforcement extends substantially from one end of each wall segment to the other and reinforcement rods fixed thereto fix to said lock part and to said camming assembly to form an embedded continuous integrated steel skeleton in said composite wall.

14. The structure of claim 12 wherein conduit openings are cast in said sill and stud structure at a location to lie interiorly of said insulation and to be longitudinally open through said end studs.

15. The structure of claim 1 wherein said footing surface is provided on concrete footings situated between concrete form boards; a concrete floor rests on said footing surface in abutment with said composite wall; a layer of particulate material is provided on the earth below said floor; and a pipe extends through said floor into said layer and has perforate openings for admitting flow from the layer to the upper end of said pipe.

16. The structure of claim 15 wherein the upper end of said pipe communicates with one or both of a radon removing gas pump or a liquid removing sump pump, and said floor comprise edge-interlocked floor panels having recessed floor passages in their undersurface.

17. A method comprising the steps of:

a. providing a footing surface in a predetermined configuration;

b. placing first and second concrete wall segments, with interior and exterior surfaces and opposite ends having endmost concrete wall sections, in generally longitudinally oriented relation to form a vertically extending composite wall on said footing surface; one of said endmost wall sections on said first segment having an embedded horizontally extending lock part and one of said endmost wall sections on said second segment having an embedded camming assembly for receiving said lock part;

c. relatively moving said ones of said wall sections together to receive said lock part in the camming assembly; and d. creating further relative movement of said ones of said endmost wall sections into locked abutting relation by operating said camming assembly to draw the lock part and cam assembly relatively longitudinally.

18. The method of claim 17 wherein a manipulatable actuator is provided for operating said camming assembly through the interior surface of the wall segment carrying said camming assembly, and the step of manipulating said actuator to operate said camming assembly is performed.

19. The method of claim 18 including the step of inserting a perpendicularly extending cam pin actuator, with an axially adjustable frustroconical cam portion thereon, through said lock pin in a direction transversely of said segments, said camming assembly having an enlarged diameter sleeve with an axially beveled piloted section into which said cam pin is also inserted to interact said cam portion and piloting section upon relative axial movement of said cam pin and sleeve; said cam pin being a threaded member and said camming assembly being operable when said cam portion is moved therelong on rotation of said cam pin.

20. The method of claim 17 including casting at least one of said wall segments as a shell with an outer continuous wall and integrated vertical concrete studs projecting inwardly therefrom; prior to step b, placing insulation in said shell between the studs; and thereafter prior to step b, fixing wall board in position over the studs and insulation as the interior surface of said shell covering said insulation.

21. The method of claim 17 wherein a floor is fabricated for said composite wall by placing floor panels, with interlocking horizontally lapping edges in interlocked position, adjacent said wall segments on said footing surface prior to step b.

22. A building structure comprising:

a. a footing surface arranged in a predetermined configuration;

b. end to end matching first and second concrete wall shell segments, with interior and exterior surfaces, oriented in generally longitudinally abutting relation to form a vertically extending composite wall system on said footing surface, the shell segments comprising exterior walls with inwardly projecting studs and end walls;

c. one of said shell segments having an embedded horizontally extending lock part and the other shell segment having an embedded lock part receiving assembly for receiving said lock part and together forming an interengaged locking system for locking said adjoining shell segments into abutting relation;

d. reinforcing mesh extending in said exterior walls of said shell segments from substantially one end of each of said shell segments to the other end of shell segments, reinforcing rods fixed to said lock part and to said lock part receiving assembly, and fixed to said mesh to provide an integrated concrete embedded reinforcement network spanning said composite wall system; and e. a manipulatable actuator extending from the interior surface of one of said shell segments inwardly to said locking system for operating said lock system.

23. The structure of claim 22 wherein said shell segments have abutting end walls with respective projection and recess nesting sections in nesting relationship; said receiving assembly is a camming assembly; and said lock part and camming assembly are embedded in said respective nesting sections; and said actuator is housed in a tube open to the interior face of one of said shell segment end walls and operatively engages said camming assembly.

24. The structure of claim 23 wherein said lock part has an end portion which projects longitudinally from said shell segment end wall in which it is embedded and has a perpendicularly extending cam pin, with an axially adjustable frustroconical cam portion thereon, extending in a transverse direction and constituting said actuator, the adjoining shell segment end wall having an embedded enlarged diameter sleeve with an axially beveled piloting section receiving said cam pin to interact said cam portion and piloting section upon axial movement of said cam pin.

25. A method comprising the steps of:

a. providing a footing surface in a predetermined configuration;

b. placing a vertical reinforcement network comprising a mesh wall, having inset vertical reinforcing rods pinned to said mesh wall and fixed to vertically spaced wall interlock parts at each end of the mesh wall, in a concrete mold;

c. in said mold, casting concrete wall shell segments with an exterior vertical wall in which said mesh wall is embedded and inwardly projecting end studs in which said vertical reinforcing rods and said interlock parts are embedded;

d. placing said shell segments in generally longitudinally oriented abutting relation to form a vertically extending composite wall system on said footing surface; and e. operating said interlock parts to lock the abutting shell segments together.

26. The method of claim 25 wherein said wall interlock part on one end of the mesh wall are camming assemblies and on the other end of the mesh wall are projecting lock parts adapted to be received by such camming assemblies; an actuator is carried by each projecting lock part and housed in a transverse inwardly open tube cast in the shell segment in which said camming assembly interlock parts are embedded; and relative movement of said shell segments into locked abutting relation is created, by operating said actuators to draw the projecting lock parts and cam assemblies, and thereby those wall shell segments relatively longitudinally.

27. The method of claim 26 wherein said shell segments have integrated, inwardly projecting vertical concrete interior studs with vertical reinforcement rods embedded therein which are connected to said mesh wall by crossrods, insulation is placed in said shell segments between the studs, and wallboard is fixed in position over the studs and insulation.

28. A concrete subterranean first wall shell segment with a reinforced exterior wall having longitudinally spaced vertical inwardly projecting studs including end studs, comprising;

a. a generally longitudinally projecting lock part embedded in one of the end studs to project therefrom and cooperate with a lock part receiving assembly embedded in the end stud of an adjoining shell segment;

b. insulation between said studs adjacent said exterior wall; and c. wall board fixed in position over said studs.

29. The structure of claim 28 comprising:

a. an adjoining concrete shell segment having a reinforced exterior wall and like inwardly projecting, longitudinally spaced vertical studs;

b. the adjoining shell segment having a camming assembly comprising the lock part receiving assembly embedded in one of its end studs receiving said lock part embedded in the first shell segment;

c. insulation between said studs of the adjoining shell segment;

d. wall board fixed in position over said studs of the adjoining shell segment, said wall board providing an interior face and being formed with an opening therein over said camming assembly; and e. a tube cast in said one end stud of the adjoining shell segment having an actuator therein accessible through said wall board opening for operating said camming assembly to draw the lock part and camming assembly relatively longitudinally and lock the shell segments together.

30. A method of making a first concrete subterranean wall shell segment having an exterior wall with inwardly projecting vertical studs including end studs, comprising the steps of;

a. placing an integrated reinforcement network comprising a mesh wall having lock parts fixed to each of its ends in a concrete mold;

b. casting said shell segment to embed said mesh wall in said exterior wall and said lock parts in the end studs;

c. placing insulation between said vertical studs adjacent said exterior wall; and d. fixing wall board in position over said studs.

31. The method of claim 30 wherein an adjoining concrete shell segment is cast with end studs in which lock parts are embedded, and the lock part cast in one shell segment end stud of said first shell segment is a longitudinally projecting lock part while the lock part cast in one of said end studs of said adjoining concrete shell segment is a lock part receiving camming assembly, and including the further steps of;

a. placing the first concrete shell segment and adjoining concrete shell segment in longitudinally abutting relation with the said longitudinally projecting lock part received by the camming assembly; and b. operating said camming assembly to draw the lock part and camming assembly, and thereby the first and adjoining wall shell segments, relatively longitudinally to lock the first and adjoining shell segments together.

* * * * *

UNITED STATES PATENT AND TRADEMARK OFFICE

CERTIFICATE OF CORRECTION

PATENT NO. : 5,953,864

DATED : September 21, 1999

INVENTOR(S) : William G. Beck

It is certified that error appears in the above-indentified patent and that said Letters Patent is hereby corrected as shown below:

Column 9, line 57, should read --it-- instead of "the sleeve".

Column 11, line 39, should read after "of"(second occurance) insert --each of said--

Signed and Sealed this

Twenty-ninth Day of February, 2000

*Attest:*

Q. TODD DICKINSON

*Attesting Officer*

*Commissioner of Patents and Trademarks*